United States Patent [19]

Uchida et al.

[11] 4,455,849

[45] Jun. 26, 1984

[54] PRESS-ROLLING PROCESS FOR PRODUCING A METAL TUBULAR PRODUCT

[75] Inventors: Shigeru Uchida; Kazuo Watanabe; Kousaku Ozawa, all of Kitakyushyu; Minoru Kawaharada, Sakai, all of Japan

[73] Assignee: Nippon Steel Corporation, Tokyo, Japan

[21] Appl. No.: 255,482

[22] Filed: Apr. 20, 1981

[30] Foreign Application Priority Data

Apr. 21, 1980 [JP] Japan ..... 55-51778

[51] Int. Cl.[3] ..... B21B 17/10

[52] U.S. Cl. ..... 72/41; 72/209

[58] Field of Search ..... 72/68, 97, 206, 209, 72/366, 41, 42; 428/583

[56] References Cited

U.S. PATENT DOCUMENTS 2,791,924 5/1957 Sawyer ..... 72/209

3,391,561 7/1968 Calmes ..... 72/206

3,818,733 6/1974 Cauley et al. ..... 72/41

4,006,618 2/1977 Yanagimoto et al. ..... 72/209

*Primary Examiner*—Daniel C. Crane

*Attorney, Agent, or Firm*—Kenyon & Kenyon

[57] ABSTRACT

In a press-rolling process for producing a metal tubular product, which comprises a pipe-forming procedure in which a square metal billet is fed into a rolling mill which consists of a pair of pressing rolls which have semi-circular grooves forming circular shape and which is provided with a plug held in the center line of the circular shape, according to the present invention, the press-rolling process is characterized in that a cavity is formed in the center portion of the forward surface of the billet before the pipe-forming procedure, the diameter of the cavity corresponding to 70% or more but less than 100% of the diameter of the plug and the volume of the cavity being equal to or more than the volume of a portion of the plug located in the inserting side of the billet from the axial center of the rolling mill.

3 Claims, 9 Drawing Figures

PRIOR ART Fig. 1C

PRESS-ROLLING PROCESS FOR PRODUCING A METAL TUBULAR PRODUCT

BACKGROUND OF THE INVENTION

1. Field of the Invention

The present invention relates to a press-rolling process for producing a metal tubular product, in particular, a press-rolling process for producing a steel pipe from square billet by means of a press rolling piercer.

2. Description of the Prior Art

A press rolling piercer is, as described in Japanese patent publication No. 54–23675, an apparatus wherein a square billet is inserted into a pair of pressing rolls which are arranged opposite to each other in the vertical direction. A pusher applies pressure on the billet in the axial direction thereof and simultaneously, a plug is used to pierce the square billet.

In the rolling process using such a press-rolling piercer, if the materials are rolled within the mill capacity, no trouble occurs.

When an alloy of steel has a resistance to deformation beyond mill capacity, such as when special high alloy steel is rolled, the magnitude of the pusher pushing force, the rolling load, the plug thrust force and the torque etc. exceed the tolerance value of the mill capacity. In particular, the problem of the peak load, which appears when the front end of the billet is held by rolling mill rolls, is the most important.

In the rolling process using the piercer, the rolling operation progresses as illustrated in FIG. 1A to FIG. 1C. In the step illustrated in FIG. 1A, a steel billet 1, a pair of rolls 2, 2' and a plug 3 mounted on the end of a mandrel 4 are substantially and simultaneously contacted and then, the rolling operation progresses as illustrated in FIG. 1B. As a result, the plug 3 pushes out the billet metal situated at a substantially central position wherein the billet metal pushed out has the same volume as the plug. A part of the pushed billet metal flows in the longitudinal direction of the billet, another part flows in the transverse direction, and the remainder forms bulging at the entrance of piercing stage. This phenomenon is maintained even during steady rolling of the billet as illustrated in FIG. 1C.

In the step wherein a plug pushes out the billet metal as illustrated in FIG. 1B the thrust force of the plug continues to increase, reaches a peak load, and then is maintained at a little lower level than the peak load.

In a case where materials have a high resistance to deformation, such as when high alloy steel is pierced in a rolling mill designed for mild steel material, the peak load exceeds the capacity of the mill.

SUMMARY OF THE PRESENT INVENTION

Accordingly, it is an object of the present invention to provide an improved and new rolling process for producing a pipe.

The objects of present invention are achieved by a press-rolling process for producing a metal tubular product, which conprises a pipe-forming procedure in which a square metal billet is fed, under a pressure applied by pusher thereto in the axial direction thereof, into a rolling mill which consists of a pair of rolls arranged opposite to each other in the vertical direction, which have semi-circular grooves formng circular shape and which is provided with a plug held in the center line of the said circular shape, while allowing said plug to pierce said billet along the longitudinal axis thereof, which process is characterized in that a cavity is formed in the center portion of the forward surface of said billet before said pipe-forming procedure, the diameter of said cavity corresponds to 70% or more but less than 100% of the diameter of said plug and the volume of said cavity is equal to or more than the volume of a portion of said plug located in the inlet side of said billet from the axial center of said rolling mill, and, then, said billet is fed into said rolling mill in such a manner that said plug is inserted into said cavity.

BRIEF EXPLANATION OF THE DRAWINGS

FIGS. 1A to 1C are views showing the progress of the press piercing process.

DETAILED DESCRIPTION OF THE INVENTION

Figure 1A:
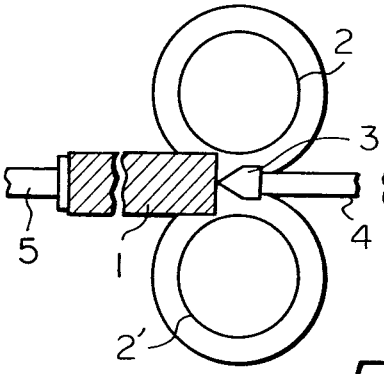
Fig. 1A PRIOR ART
Figure 1B:
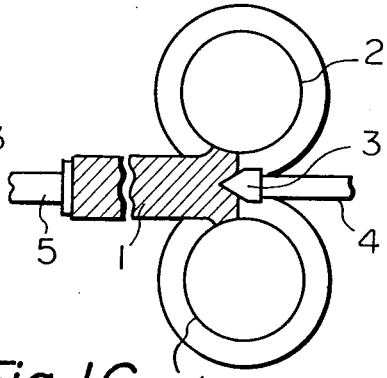
Fig. 1B PRIOR ART
Figure 1B:
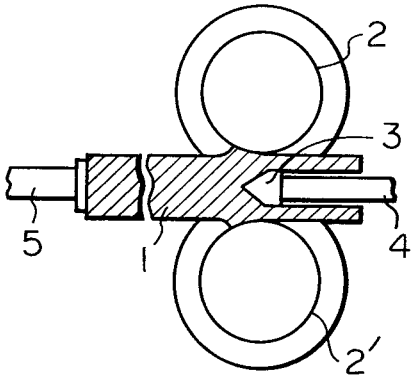
Fig. 1B PRIOR ART
Figure 2A:
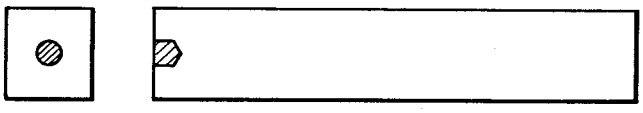
FIG. 2A and FIG. 2B are respectively a plan view; and a vertical sectional view illustrating the case wherein a cavity is formed at the surface of the square billet according to the present invention.
Figure 2B:
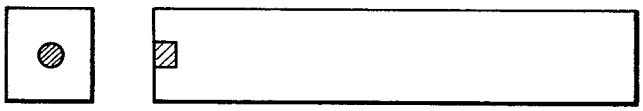
Figure 3A:
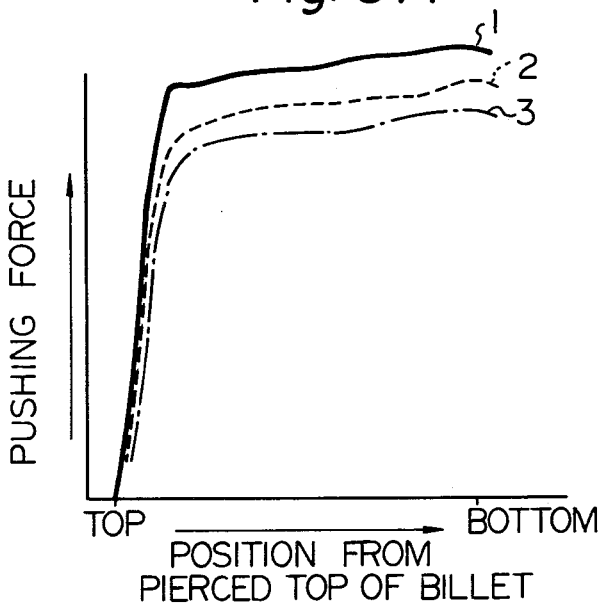
FIG. 3A to FIG. 3D are graphs showing test results of the pushing force, the plug thrust force, the torque, to rolling load, and comparing the prior art with the present invention.
Figure 3B:
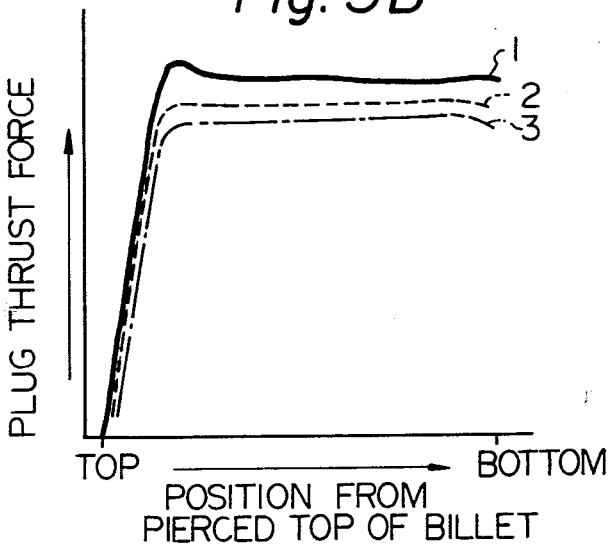
Figure 3C:
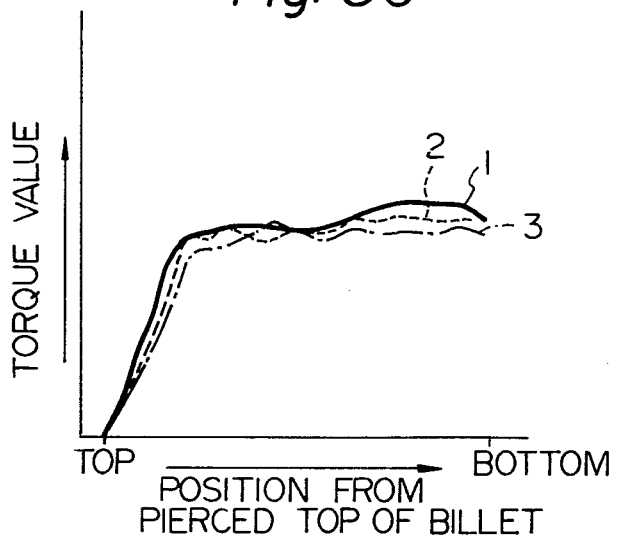
Figure 3D:
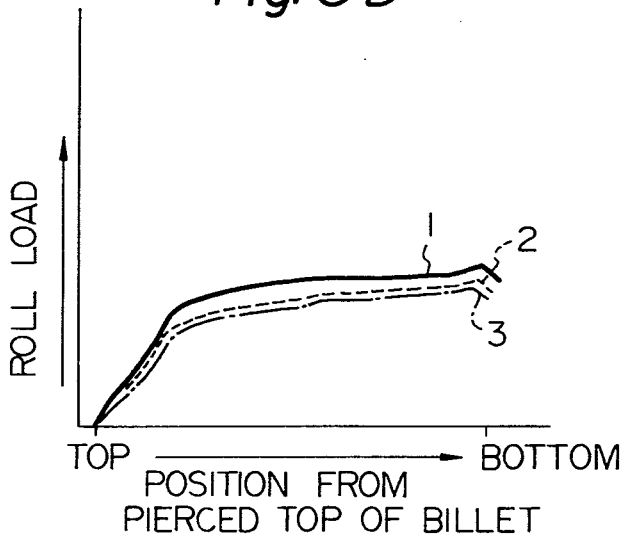

The present invention is carried out by using a square billet in which a cavity shown in FIGS. 2A or 2B is formed. The diameter of the cavity should correspond to 70% or more, of the diameter of the plug, since a cavity whose diameter is less than 70% of the diameter of the plug is not capable of eliminating the peak load shown in FIG. 3B. Furthermore, the diameter of the cavity should be in a range of less than 100% of the diameter of the plug since the cavity having a diameter of 100% or more of the diameter of the plug, causes disadvantages such as the cross sectional shape of the rolled pipe is not round at the periphery of the rolled pipe and the thickness of the rolled pipe has eccentricity because of the free bendability of the plug in the cavity. In addition, the volume of the cavity is equally important. If the volume of the cavity is smaller than that of the portion of the plug located on the inlet side of the billet from the vertical plane containing the roll axes, some portion of the excess metal to be replaced by the plug forms bulging which maintains the mill load high. Hence, the volume of the cavity should be equal to or more than that of the plug portion in order to eliminate the excess metal.

In a press piercing process and a Mannessmann piercing process which are similar to the above mentioned process and which has been disclosed in German patent No. 1302427 [corresponding to British Patent Specification No. 1,008,709]a process including the steps of forming a hole at the front surface of the rolling material and piercing the rolling material has being carried out. However, the object of the present invention is to guide the top portion of the plug in the center of the front surface end of the rolling material so as to prevent eccentric thickness of the rolled pipe. The volume of the hole is much smaller than that of the plug. Accordingly, this conventional process has different objects and different deformations than the process of the present invention.

In the present invention, it is preferable that the cavity is in the shape of a circular cone or a cylinder with a cone-shaped end. Further, it is preferable that the surface of the plug is lubricated with a lubricant before said plug is inserted into the cavity. The lubricants flow into a cavity formed in the billet and prevents thickness enlargement from being generated at the front end of the rolled billet, and further the load occurring during the rolling can be advantageously reduced. The lubricant advantageously consists of a member selected from the group consisting of grease, a mixture of grease and graphite and mixtures of grease and salts.

Since the volume of the cavity is not necessarily more than that of the plug and the volume which is substantially proportionate to the size of the cavity, the most suitable volume of the cavity is determined after consideration of both the cost of forming the cavity and the effect of load reduction.

According to the present invention some products such as high alloy steel etc. are capable of being rolled. Furthermore, the combination of a cavity having a suitable volume together with plug lubrication has a low production cost.

As mentioned above, according to the present invention, various steel and billet sizes beyond the conventional mill capacity are capable of being pierced. As a result, the mill capacity is increased.

The examples will now be explained with reference to FIG. 3A to FIG. 3D.

Example 1

A square billet having a side length of 113 mm and a billet length of 1000 mm was used. Then the piercing rolling process was carried out. FIG. 3A, FIG. 3B, FIG. 3C and FIG. 3D show the pushing force, the plug thrust force, the torque and the rolling load respectively in three cases. The line 1 is a case where a cavity was not formed in the billet. The broken line 2 is a case where a cavity having a diameter of 65 mm and length of 30 mm was formed in the billet. The line 3 is a case where the above mentioned cavity was formed and further, a lubricant made up of grease and graphite was applied to the plug.

As shown in FIG. 3 it was found that the rolling load was reduced according to the present invention.

We claim:

1. In a press-rolling process for producing a metal tubular product in a rolling mill having a pair of rollers arranged opposite to each other in the vertical direction wherein said rollers have semi-circular grooves forming a circular shape, said process including the steps of:

feeding a square metal billet having a forward surface and a rearward surface into said rolling mill by applying a pressure on said rearward surface in the axial direction of said billet with a pusher;

providing a plug held in the center line of said circular shape formed by said semi-circular grooves whereby said plug is aligned with the center portion of said billet being fed into said rolling mill;

positioning said plug such that a portion of said plug is located beyond the axial center line of said rolling mill on the side of said rolling mill where said billet is inserted by said feeding step;

allowing said plug to pierce said billet by continuing said feeding step thereby producing said tubular product; the improvement in which comprises:

forming a cavity in the center portion of said forward surface of said billet and open only at the forward surface prior to said feeding step wherein said cavity has a diameter of at least 70% but less than 100% of the diameter of said plug and a volume at least equal to the volume of said plug portion located beyond said axial center line of said rolling mill on said billet inserting side whereby said plug is inserted into said cavity by said feeding step.

2. In a process as recited in claim 1, the improvement further comprising said cavity having a volume greater than said volume of said plug portion located beyond the axial center line of said rolling mill on the billet inserting side.

3. In a process as recited in claim 1, the improvement further comprising:

lubricating said plug prior to said feeding step with a lubricant selected from the group consisting of grease, a mixture of grease and graphite, and mixtures of grease and salts.

* * * * *